US006177657B1

(12) United States Patent
Takata

(10) Patent No.: US 6,177,657 B1
(45) Date of Patent: Jan. 23, 2001

(54) IMAGE FORMING APPARATUS WITH CONTROL WAVE NUMBER SETTING MEANS

(75) Inventor: Shinichi Takata, Toride (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/323,265

(22) Filed: Jun. 1, 1999

(30) Foreign Application Priority Data

Jun. 3, 1998 (JP) ..... 10-169188

(51) Int. Cl.[7] ..... H05B 1/02

(52) U.S. Cl. ..... 219/497; 219/501; 219/216; 219/505; 340/589

(58) Field of Search ..... 219/501, 497, 219/505, 494, 216; 340/589; 323/243, 292, 369

(56) References Cited

U.S. PATENT DOCUMENTS 5,464,964 * 11/1995 Okuda et al. ..... 219/497
5,519,190 * 5/1996 Aoki ..... 219/501
5,656,187 8/1997 Miyamoto et al. ..... 219/216
5,842,079 11/1998 Miyamoto et al. ..... 399/33

FOREIGN PATENT DOCUMENTS 5-281865 10/1993 (JP) .

* cited by examiner

*Primary Examiner*—Teresa Walberg
*Assistant Examiner*—Jeffrey Pwu
(74) *Attorney, Agent, or Firm*—Fitzpatrick, Cella, Harper & Scinto

(57) ABSTRACT

An image heating apparatus has a heater for generating heat when an electric power is supplied from a commercial power source to the heater, a temperature detecting element for detecting a temperature of the heater, a control wave number setting circuit for setting a control wave number of the electric power to be supplied to the heater, and an electric power controlling circuit for controlling the electric power supplied to the heater in accordance with a detected temperature from the temperature detecting element and the control wave number set by the control wave number setting circuit.

6 Claims, 10 Drawing Sheets

FIG. 5

⟨CORRESPONDENCE TABLE BETWEEN TEMPERATURE DIFFERENCE AND POWER SUPPLY LEVEL⟩

| ΔT (°C) | POWER SUPPLY RANK | POWER SUPPLY LEVEL | |
|---|---|---|---|
| | | NINE WAVES CONTROL | FIVE WAVES CONTROL |
| ΔT≧+10 | RANK 0 | LEVEL 0 | LEVEL 0 |
| +10>ΔT≧+7 | RANK 1 | LEVEL 1 | LEVEL 1 |
| +7>ΔT≧+5 | RANK 2 | LEVEL 2 | |
| +5>ΔT≧+3 | RANK 3 | LEVEL 3 | LEVEL 2 |
| +3>ΔT≧+1 | RANK 4 | LEVEL 4 | |
| +1>ΔT≧−1 | RANK 5 | LEVEL 5 | LEVEL 3 |
| −1>ΔT≧−3 | RANK 6 | LEVEL 6 | LEVEL 4 |
| −3>ΔT≧−5 | RANK 7 | LEVEL 7 | |
| −5>ΔT≧−7 | RANK 8 | LEVEL 8 | LEVEL 5 |
| −7>ΔT | RANK 9 | LEVEL 9 | |

$$\Delta T = \begin{pmatrix}\text{DETECTED}\\ \text{TEMPERATURE}\end{pmatrix} - \begin{pmatrix}\text{TARGET}\\ \text{TEMPERATURE}\end{pmatrix}$$

| FIG. 8A | FIG. 8B |
|---|---|

IMAGE FORMING APPARATUS WITH CONTROL WAVE NUMBER SETTING MEANS

BACKGROUND OF THE INVENTION

1. Field of the Invention

The present invention relates to an image heating apparatus used in an image forming apparatus such as a copying machine, a printer and the like.

2. Related Background Art

In the past, as image heating apparatuses used as fixing apparatuses, for example, there has been proposed a fixing apparatus comprising a heat generating resistor for generating heat when it is energized by a commercial power source, a temperature detector for detecting a temperature of the heat generating resistor, and a control means for controlling a transmission and interruption of an electric power from the commercial power source to the heat generating resistor on the basis of the temperature detected by the temperature detector, and such a fixing apparatus has been put to practical use.

In such a fixing apparatus, the temperature of the heat generating resistor is controlled by switching a condition of the apparatus to an energized condition or a de-energized condition for each half wave of an electric power outputted from the commercial power source, in accordance with the detected temperature from the temperature detector.

In this case, the control means controls the number of energizating waves within a predetermined period (control wave number) including a predetermined number of half waves of alternating current supplied from the commercial power source to the heat generating resistor, on the basis of the detected temperature.

However, since the predetermined period is constant, for example, if the predetermined period is long, although fine control of electric power can be made because the number of half waves (for each predetermined period) controllable for the transmission and interruption of the electric power from the commercial power source to the heat generating resistor is great, response to the detected temperature of the temperature detector is worsened because a time period between a previous control and a next control becomes long. On the other hand, if the predetermined period is short, although the response to the detected temperature of the temperature detector can be improved because the time period between the previous control and the next control is short, the fine control of electric power cannot be made because the number of half waves (for each predetermined period) controllable for the transmission and interruption of the electric power from the commercial power source to the heat generating resistor is small.

Therefore, when the predetermined period is constant, since the fine control of electric power and the response are not compatible, it is difficult to achieve further improvement in temperature control accuracy.

SUMMARY OF THE INVENTION

An object of the present invention is to provide an image heating apparatus in which accuracy of temperature control for a heat generating resistor can be improved and fast response can be achieved depending on the situation.

Another object of the present invention is to provide an image heating apparatus comprising a heater for generating heat when an electric power is supplied from a commercial power source to the heater, a temperature detecting element for detecting a temperature of the heater, a control wave number setting means for setting a control wave number of the electric power to be supplied to the heater, and an electric power controlling means for controlling the electric power supplied to the heater in accordance with a detected temperature from the temperature detecting element and the control wave number set by the control wave number setting means.

The other objects and features of the present invention will be apparent from the following detailed explanation referring to the accompanying drawings.

BRIEF DESCRIPTION OF THE DRAWINGS

FIG. 5 is a correspondence table showing a relationship between temperature difference (between a detected temperature and a target temperature of the thermistor 2) and power supply level, according to an embodiment of the present invention;

DESCRIPTION OF THE PREFERRED EMBODIMENTS

The present invention will now be explained in connection with embodiments thereof with reference to FIGS. 1 to 8A and 8B.

(First embodiment)

Figure 1:
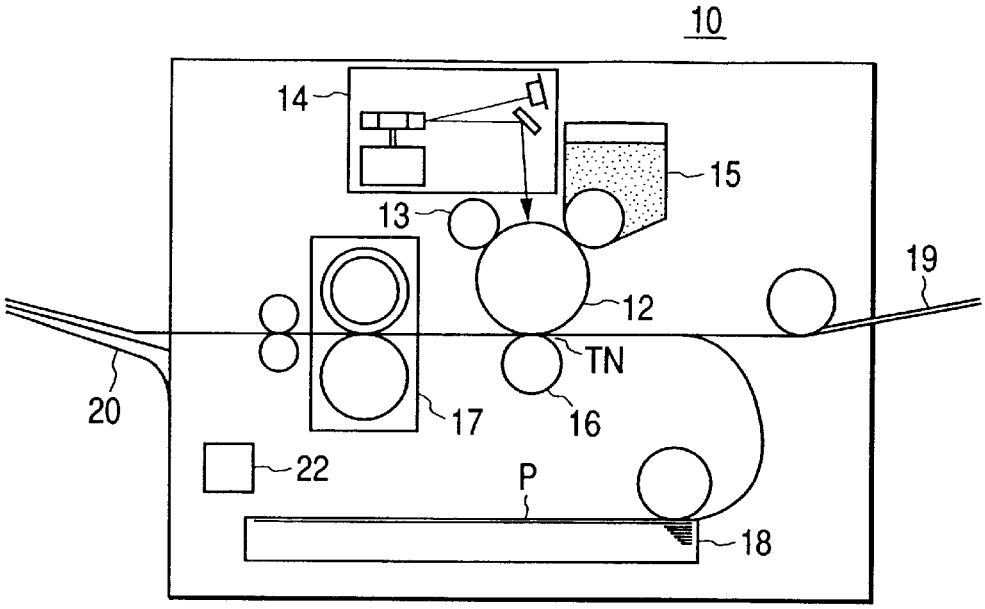
FIG. 1 is a schematic sectional view of a laser beam printer as an example of an image forming apparatus according to a first embodiment of the present invention.

FIG. 1 is a schematic sectional view of a laser beam printer (referred to merely as "printer" hereinafter) 10 as an example of an image forming apparatus according to a first embodiment of the present invention.

As shown in FIG. 1, the printer 10 includes a drum-shaped photosensitive body 12 on which an electrostatic latent image is to be formed, a roller-shaped charging body 13 for charging an outer peripheral surface of the photosensitive body 12 with predetermined potential, a laser scanner unit 14 for exposing outer peripheral surface of the photosensitive body which is charged at the predetermined potential and forming the electrostatic latent image on the outer peripheral sureface, a developing device 15 for visualizing the electrostatic latent image with developer, a roller-shaped transferring body 16 for transferring a visualized image formed on the outer peripheral surface onto a recording sheet (sheet-shaped recording medium) P, and a fixing device 17 as a fixing apparatus.

In the printer 10, first of all, the outer peripheral surface of the photosensitive body 12 charged with predetermined potential by the charging body 13 is exposed by the laser scanner unit 14 to form the electrostatic latent image on the outer peripheral surface in accordance with image information supplied to the printer 10 from an external device.

Then, the electrostatic latent image formed on the outer peripheral surface of the photosensitive body 12 is developed by the developer from the developing device 15 as the visualized image.

On the other hand, before the image is transferred, the recording sheet P is fed from a cassette 18 detachably supported by a main body of the printer 10 or a multi paper tray 19 disposed on one of side surfaces of the printer 10 to a transfer nip portion TN between the photosensitive body 12 and the transferring body 16 at a predetermined timing.

Thus, the visualized image formed on the outer peripheral surface of the photosensitive body 12 can be transferred onto the recording sheet P reached the transfer nip portion TN by electrical interaction.

Then, the recording sheet P having one surface on which the visualized image in a non-fixed condition (referred to as "non-fixed image" hereinafter) was born is subjected to heat and pressure in the fixing device 17, with the result that the non-fixed image is melted and fixed, thereby recording an image corresponding to the image information on the recording sheet P. Thereafter, the recording sheet P on which the image was recorded is discharged onto a sheet discharge tray 20 provided on the other side surface of the main body of the printer 10.

Figure 2:
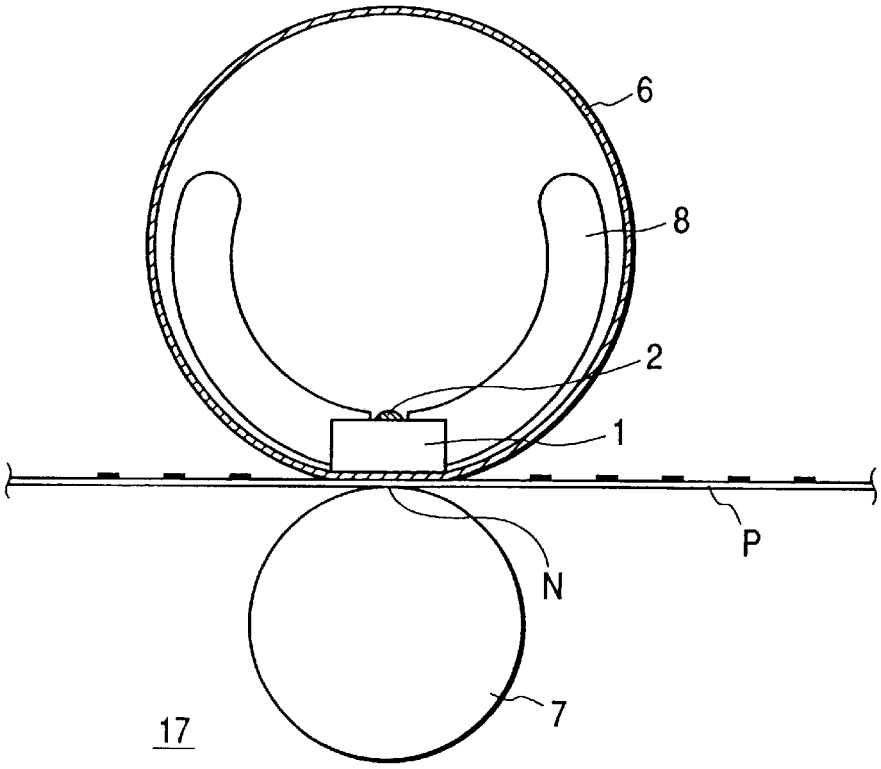
FIG. 2 is a schematic sectional view of a fixing apparatus according to the first embodiment of the present invention.
Figure 3:
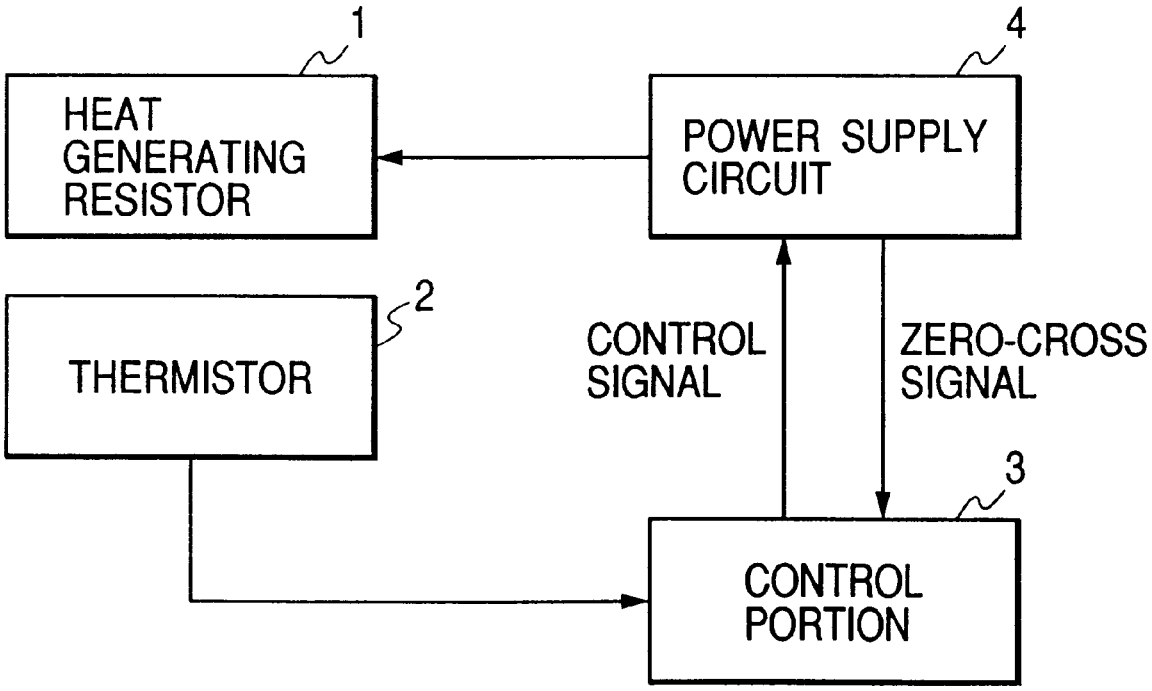
FIG. 3 is a block diagram showing signal paths between a temperature control system and the fixing apparatus according to the first embodiment.

FIG. 2 is a schematic sectional view of the fixing device 17 according to the first embodiment, and FIG. 3 is a block diagram showing signal paths between a temperature control system and the fixing apparatus according to the first embodiment.

As shown in FIG. 2, the fixing device 17 includes a heat generating resistor 1 for generating heat when it is energized by a commercial power source, a thermistor (temperature detector) 2 for detecting a temperature of the heat generating resistor 1, a support 8 for securing and supporting the heat generating resistor 1, a heat resistant film 6 loosely fitted on the heat generating resistor 1 and the support 8, and a pressure roller in the shape of body of rotation 7 being pressure-contacted with the heat generating resistor 1 through the film 6.

A control unit 22 attached to the main body of the printer 10 having the fixing device 17 includes a power supply circuit (switching means) 4 for switching between a transmission and an interruption of an electric power from the commercial power source to the heat generating resistor, and a control portion (control means) 3 for controlling the switching of the power supply circuit 4 on the basis of a detected temperature from the thermistor 2.

In the fixing device 17, the film 6 is slidingly shifted by rotating the pressure roller 7, with the result that, while the recording sheet P bearing the non-fixed image is being passed through a nip portion N between the film 6 and the pressure roller 7, the non-fixed image is fixed to the recording sheet P by the heat from the heat generating resistor 1 through the film 6.

The control portion 3 serves to control the switching of the power supply circuit 4 to provide the transmitting condition or the interrupting condition for each half wave of the electric power from the commercial power source in accordance with the detected temperature of the thermistor 2, to control an electricity amount from the commercial power source to the heat generating resistor 1 on the basis of a predetermined period (control wave number) and to control the switching of the switching means by selecting one of a plurality of pre-set predetermined periods in accordance with the pre-set rule or on the basis of the detected temperature of the temperature detector.

In FIG. 3, the control portion 3 serves to control the transmission and interruption of the electric power from the commercial power source to the heat generating resistor 1 by outputting a control signal (for switching the power supply circuit 4) to the power supply circuit 4 on the basis of data which was previously determined to set the detected temperature of the thermistor 2 to a predetermined temperature.

In this case, a zero-cross signal (signal obtained when voltage of the commercial power source through the power supply circuit 4 becomes zero) is inputted to the control portion 3, and, in synchronous with the zero-cross signal, the power supply circuit 4 is switched to the transmitting condition or the interrupting condition of the electric power for each half wave of an electric power outputted from the commercial power source.

Figure 4A:
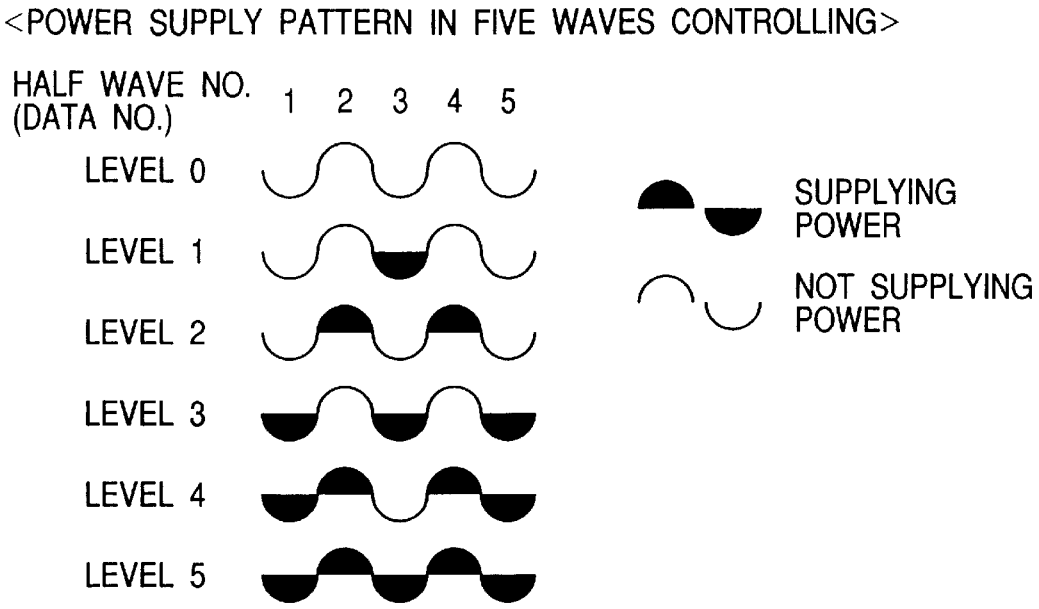
FIGS. 4A and 4B are views showing power supply patterns for controlling a transmission and interruption of an electric power from a commercial power source to a heat generating resistor 2, according to an embodiment of the present invention.
Figure 4B:
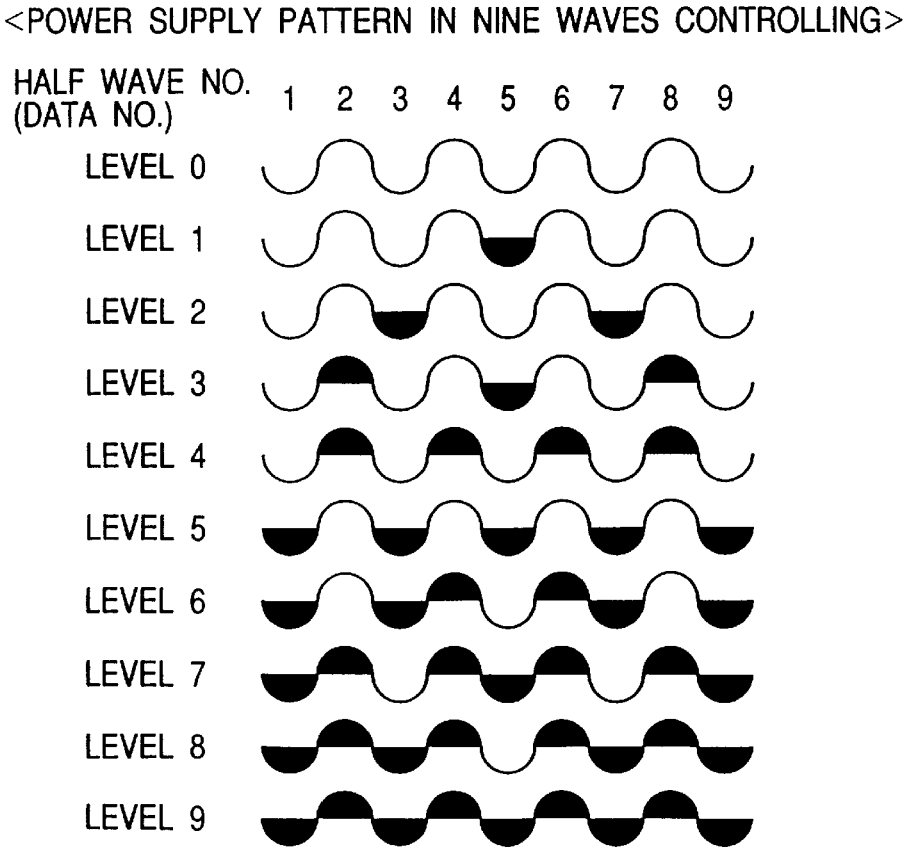

FIGS. 4A and 4B are views showing power supply patterns for controlling the transmission and interruption of an electric power from the commercial power source to the heat generating resistor 2, according to an embodiment of the present invention.

Particularly, FIG. 4A shows a power supply pattern when the predetermined period includes five half waves of the electric power from the commercial power source (referred to as "AC five half waves" hereinafter), and FIG. 4B shows a power supply pattern when the predetermined period includes nine half waves of the electric power from the commercial power source (referred to as "AC nine half waves" hereinafter).

In a control with using the AC five half waves as the predetermined period (referred to as "five waves controlling" hereinafter), five half waves having data numbers (half wave numbers) from 1 to 5 are individually supplied or non-supplied. Accordingly, this control includes six power supply patterns from 0 wave power supply (level 0) to 5 wave power supply (level 5).

In a control with using the AC nine half waves as the predetermined period (referred to as "nine waves controlling" hereinafter), nine half waves having data numbers (half wave numbers) from 1 to 9 are individually supplied or non-supplied. Accordingly, this control includes ten power supply patterns from 0 wave power supply (level 0) to 9 wave power supply (level 9).

Next, a method for determining the power supply pattern when the temperature of the heat generating resistor 2 is controlled by the control portion 3 will be explained.

FIG. 5 is a correspondence table showing a relationship between temperature difference (between the detected temperature and a target temperature of the thermistor 2) and the power supply level, according to the illustrated embodiment.

As shown in FIG. 5, the difference between the detected temperature and the target temperature of the thermistor 2 is divided into ten power supply ranks from rank 0 to rank 9 and is divided into six power supply levels (power supply patterns) in the five waves controlling and into ten power supply levels (power supply patterns) in the nine waves controlling.

The control portion 3 determines the power supply patterns in the five waves controlling and in the nine waves controlling respectively in accordance with the difference between the detected temperature and the target temperature of the thermistor 2 for each predetermined period, on the basis of the correspondence table.

Figures 6, 6A:
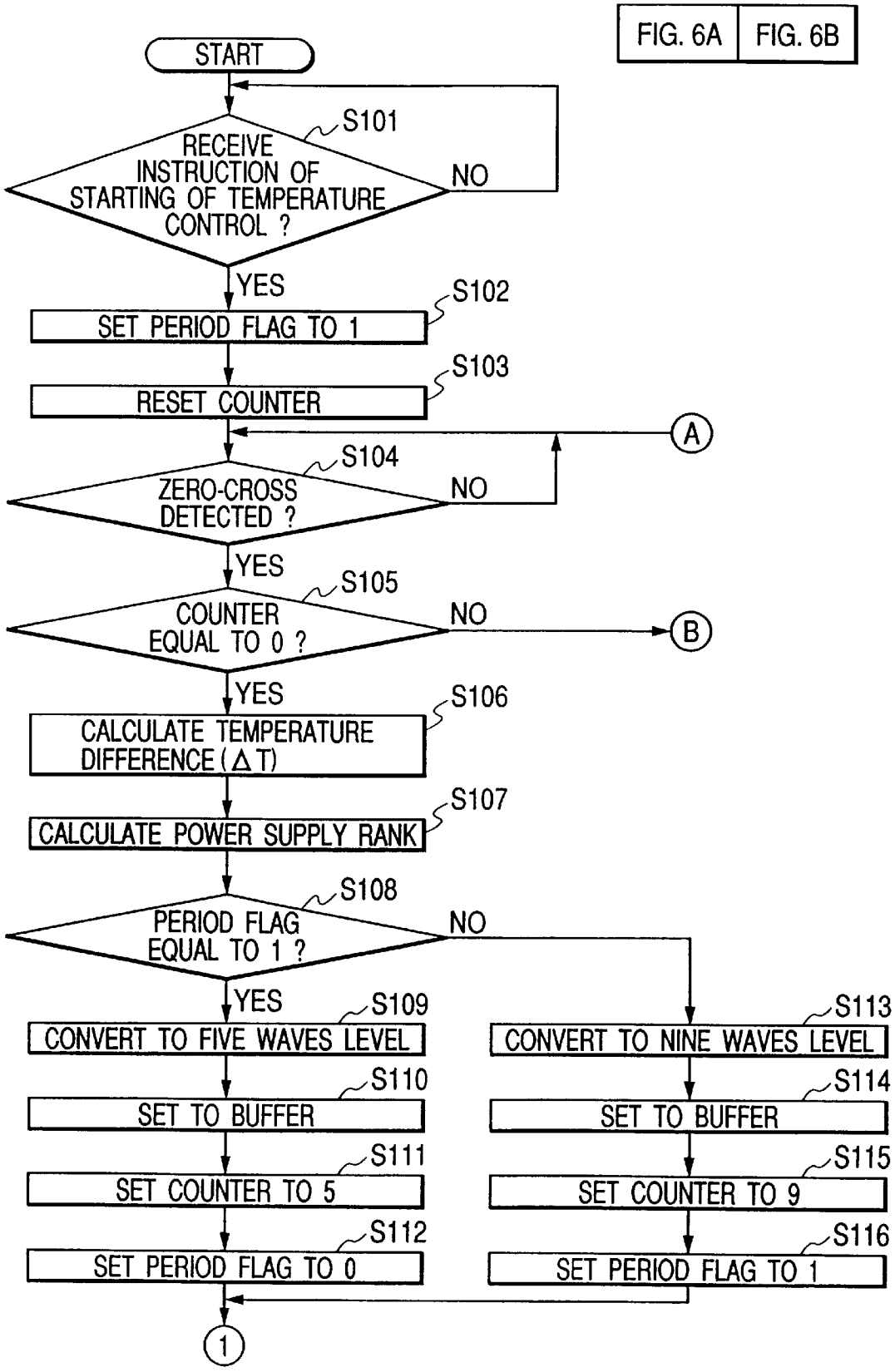
FIG. 6 which is composed of FIGS. 6A and 6B are flowcharts showing a power supply controlling operation according to the first embodiment of the present invention.
Figure 6B:
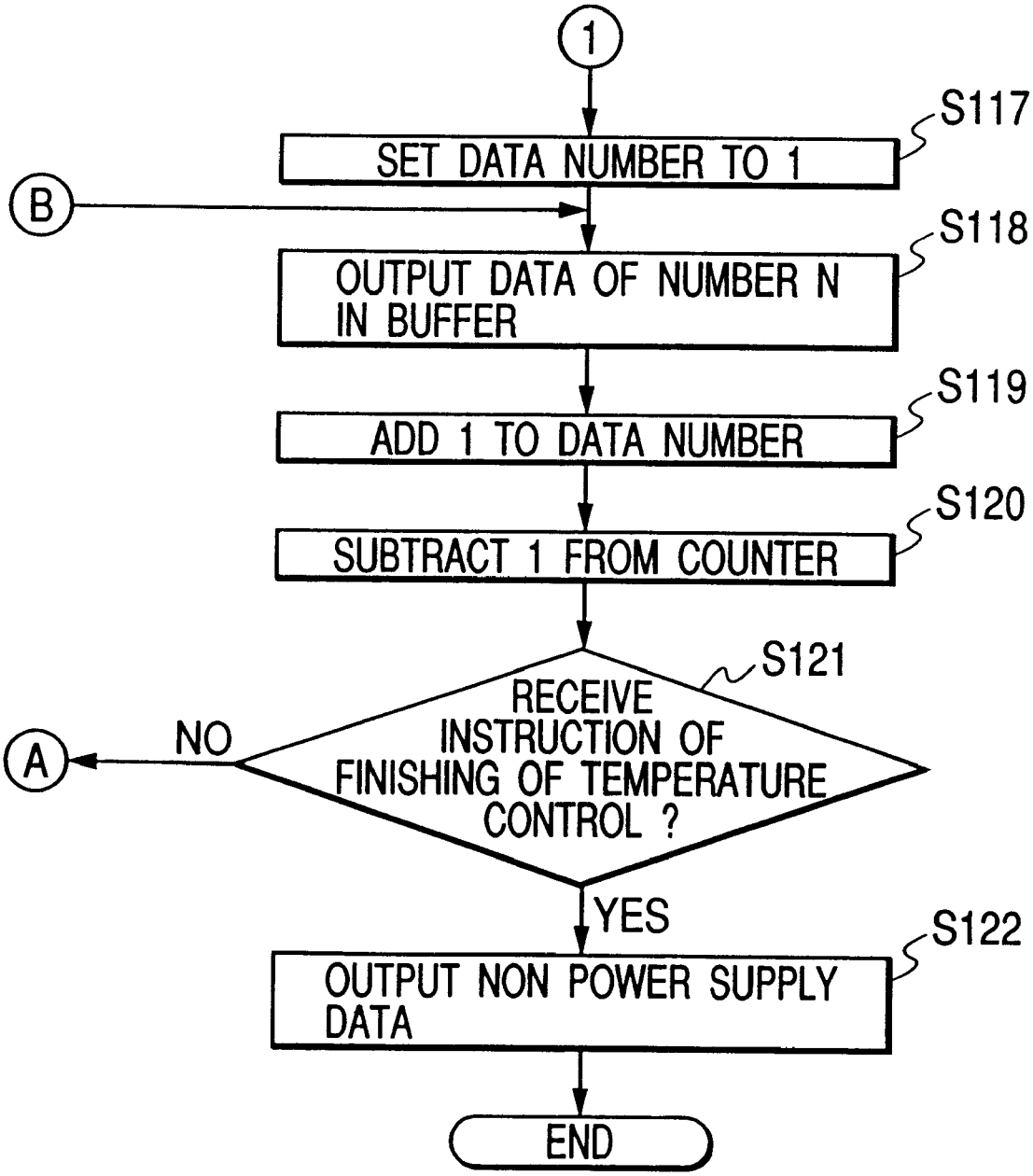

Next, the power supply controlling operation in the illustrated embodiment will be explained with reference to flowcharts shown in FIGS. 6A and 6B. Incidentally, in the illustrated embodiment, while an example that the controlling is effected by using software was explained, hardware may be used.

When instruction of starting of temperature control (not shown) is received (step S101), the control portion 3 initializes a predetermined period control flag (referred to as "period flag" hereinafter) for determining the predetermined period to "1" (step S102) and resets a counter (referred to as "zero-cross counter" hereinafter) for counting the zero-cross number to "0" (step S103) and waits for the zero-cross signal from the power supply circuit 4 (step S104).

Then, when the control portion 3 receives the zero-cross signal, the control portion 3 discriminates whether the zero-cross counter is "0" or not (step S105). If the zero-cross counter is not "0", the program goes to a step S118 (described later). On the other hand, if the zero-cross counter is "0", the difference ΔT between the target temperature and the temperature of the heat generating resistor 1 detected by the thermistor 2 is calculated (step S106), and the power supply rank is determined in accordance with the difference ΔT on the basis of the correspondence table shown in FIG. 5 (step S107).

Then, if the period flag is "1", the control portion 3 converts the power supply rank determined (in the step S107) into the power supply level in the five waves controlling on the basis of the correspondence table shown in FIG. 5 (step S109) and temporarily stores the power supply pattern data shown in FIG. 4A in an output buffer (step S110) and sets the zero-cross counter to "5" (step Slll) and the period flag to "0" (step S112).

On the other hand, if the period flag is "0", the control portion 3 converts the power supply rank determined (in the step S107) into the power supply level in the nine waves controlling on the basis of the correspondence table shown in FIG. 5 (step S113) and stores the power supply pattern data shown in FIG. 4B in the output buffer (step S114) and sets the zero-cross counter to "9" (step S115) and the period flag to "1" (step S116).

Then, the control portion 3 initializes the data number to "1" (step S117), with the result that the output data of the predetermined period (AC five half waves or AC nine half waves) is set in the output buffer.

After the output data is set in the output buffer or if the zero-cross counter is not "0" (step S105), the control portion 3 outputs the power supply pattern data for each data number ("supplying power" or "not supplying power") in the output buffer to the power supply circuit 4 (step S118).

Thereafter, the control portion 3 adds "1" to the data number (step S119) and subtracts "1" from the zero-cross counter (step S120) and effects temperature control by repeating the operations from the step S104 to the step S120 until instruction of finishing of temperature control (not shown) is received (step S121). When the instruction of finishing of temperature control is received, the non-power supply data is outputted to the power supply circuit 4 and the temperature control is finished (steps S121 and S122).

In this way, since the power supply circuit 4 is controlled by the control portion 3 by alternately switching two predetermined periods having different time lengths (five waves controlling and nine waves controlling), response to the detected temperature of the thermistor 2 in the control portion 3 and fine control of the power supply circuit 4 are compatible, thereby achieving high accurate temperature control.

(Second embodiment)

Next, a second embodiment of the present invention will be explained with reference to FIGS. 7A and 7B.

Since a fixing apparatus according to the second embodiment has the same construction as that in the first embodiment as shown in FIGS. 2 and 3, the same elements are designated by the same reference numerals and explanation thereof will be omitted.

Figures 7, 7A:
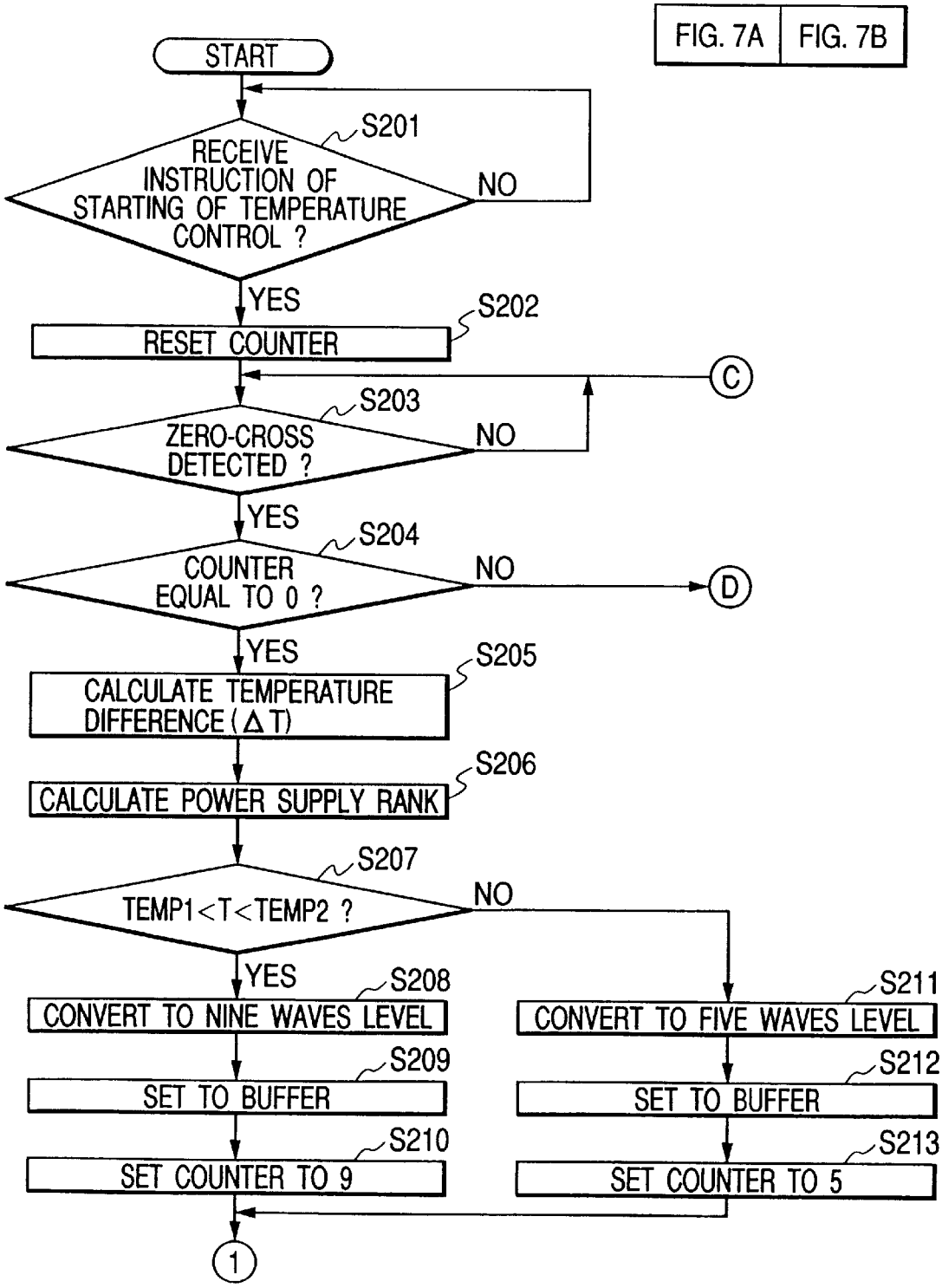
FIG. 7 which is composed of FIGS. 7A and 7B are flowcharts showing a power supply controlling operation according to a second embodiment of the present invention.
Figure 7B:
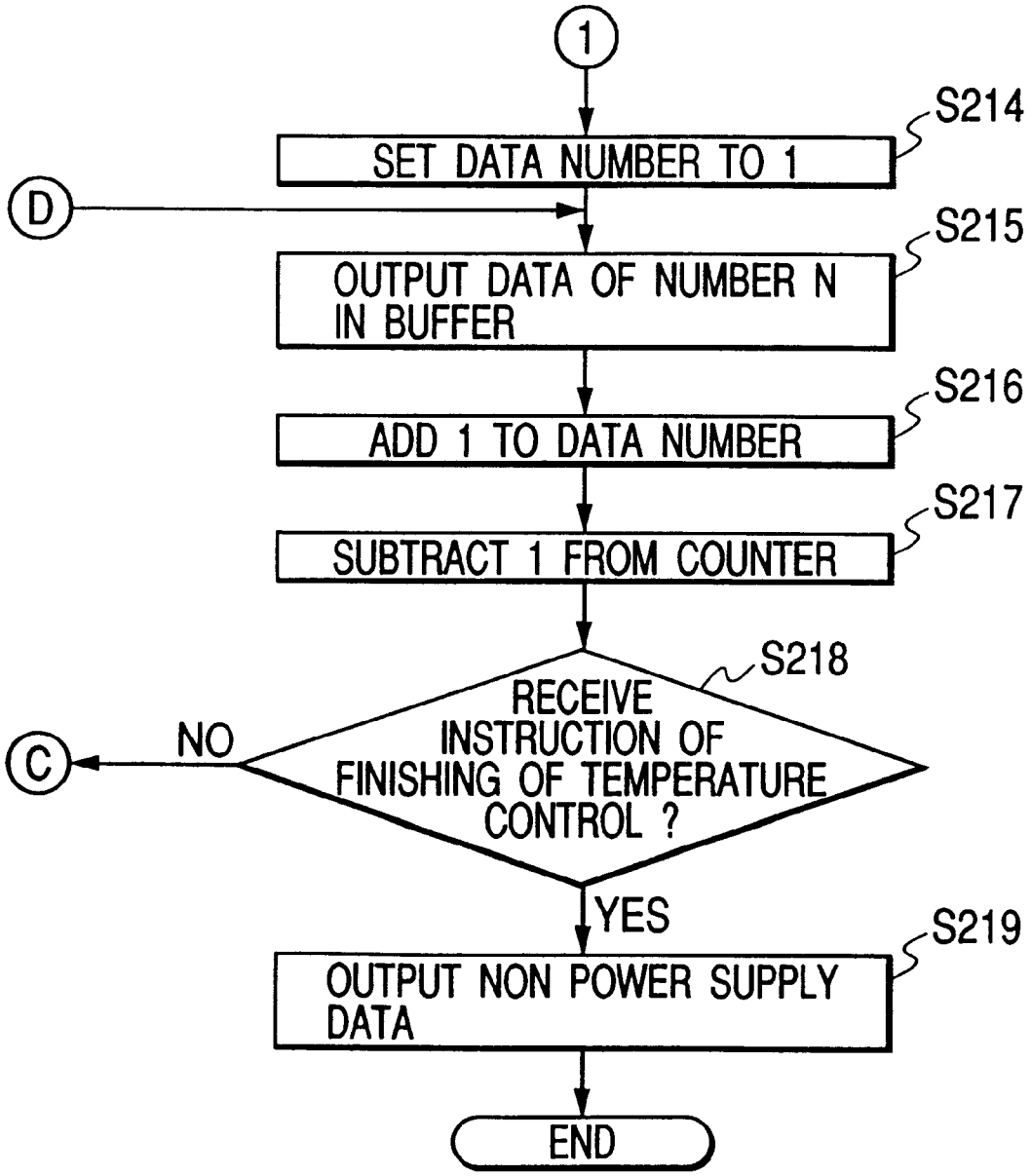

FIGS. 7A and 7B are flowcharts showing a power supply controlling operation of the fixing apparatus according to the second embodiment.

When instruction of starting of temperature control (not shown) is received (step S201), the control portion 3 resets the zero-cross counter to "0" (step S202) and waits for the zero-cross signal from the power supply circuit (step S203).

Then, when the control portion 3 receives the zero-cross signal, the control portion 3 discriminates whether the zero-cross counter is "0" or not (step S204). If the zero-cross counter is not "0", the program goes to a step S215 (described later). On the other hand, if the zero-cross counter is "0", the difference ΔT between the target temperature to be controlled and the temperature of the heat generating resistor detected by the thermistor is calculated (step S205), and the power supply rank is calculated in accordance with the difference ΔT on the basis of the correspondence table shown in FIG. 5 (step S206).

Then, the control portion 3 discriminates whether or not the detected temperature T of the thermistor 2 is within a temperature range between a temperature Temp smaller than the target temperature by a predetermined value and a temperature Temp2 greater than the target temperature by a predetermined value (step S207). If the detected temperature T is within the temperature range between the temperature Temp1 and the temperature Temp2, the control portion 3 converts the power supply rank calculated (in the step S206) into the power supply level in the nine waves controlling on the basis of the correspondence table shown in FIG. 5 (step S208) and stores the power supply pattern data shown in FIG. 4B in the output buffer (step S209) and sets the zero-cross counter to "9" (step S210).

On the other hand, if the detected temperature of the thermistor 2 is not within the temperature range between the temperature Temp1 and the temperature Temp2, the control portion 3 converts the power supply rank calculated (in the step S206) into the power supply level in the five waves controlling on the basis of the correspondence table shown in FIG. 5 (step S211) and stores the power supply pattern data shown in FIG. 4A in the output buffer (step S212) and sets the zero-cross counter to "5" (step S213).

Then, the control portion 3 initializes the data number to "1" (step S214), with the result that the output data of the predetermined period (AC five half waves or AC nine half waves) is set in the output buffer.

After the output data is set in the output buffer or if the zero-cross counter is not "0" (step S204), the control portion 3 outputs the power supply pattern data for each data number ("supplying power" or "not supplying power") in the output buffer to the power supply circuit 4 (step S215).

Thereafter, the control portion 3 adds "1" to the data number (step S216) and subtracts "1" from the zero-cross counter (step S217) and effects temperature control by repeating the operations from the step S203 to the step S217 until instruction of finishing of temperature control (not shown) is received (step S218). When the instruction of finishing of temperature control is received, the non-power supply data is outputted to the power supply circuit and the temperature control is finished (steps S218 and S219).

In this way, since the temperature control is effected by using the five waves controlling if the detected temperature of the thermistor 2 differs from the target temperature more than the predetermined value and the temperature control is effected by using the nine waves controlling if the detected temperature of the thermistor is near the target temperature, response to the detected temperature of the thermistor in the control portion 3 and fine control of the power supply circuit 4 are compatible, thereby achieving high accurate temperature control.

In particular, when the resistor is warmed up, the response for control is improved by the five waves controlling so that an overshoot on reaching the target temperature is restricted to a small value. On the other hand, in the vicinity of the target temperature, a fine control for transmitting and interruping the electric power can be effected by the nine waves controlling so that a temperaturer ripple is restricted to a small value.

(Third embodiment)

Next, a third embodiment of the present invention will be explained with reference to FIGS. 8A and 8B.

Since a fixing apparatus according to the third embodiment has the same construction as that in the first embodiment shown in FIGS. 2 and 3, the same elements are designated by the same reference numerals and explanation thereof will be omitted.

Figures 8, 8A:
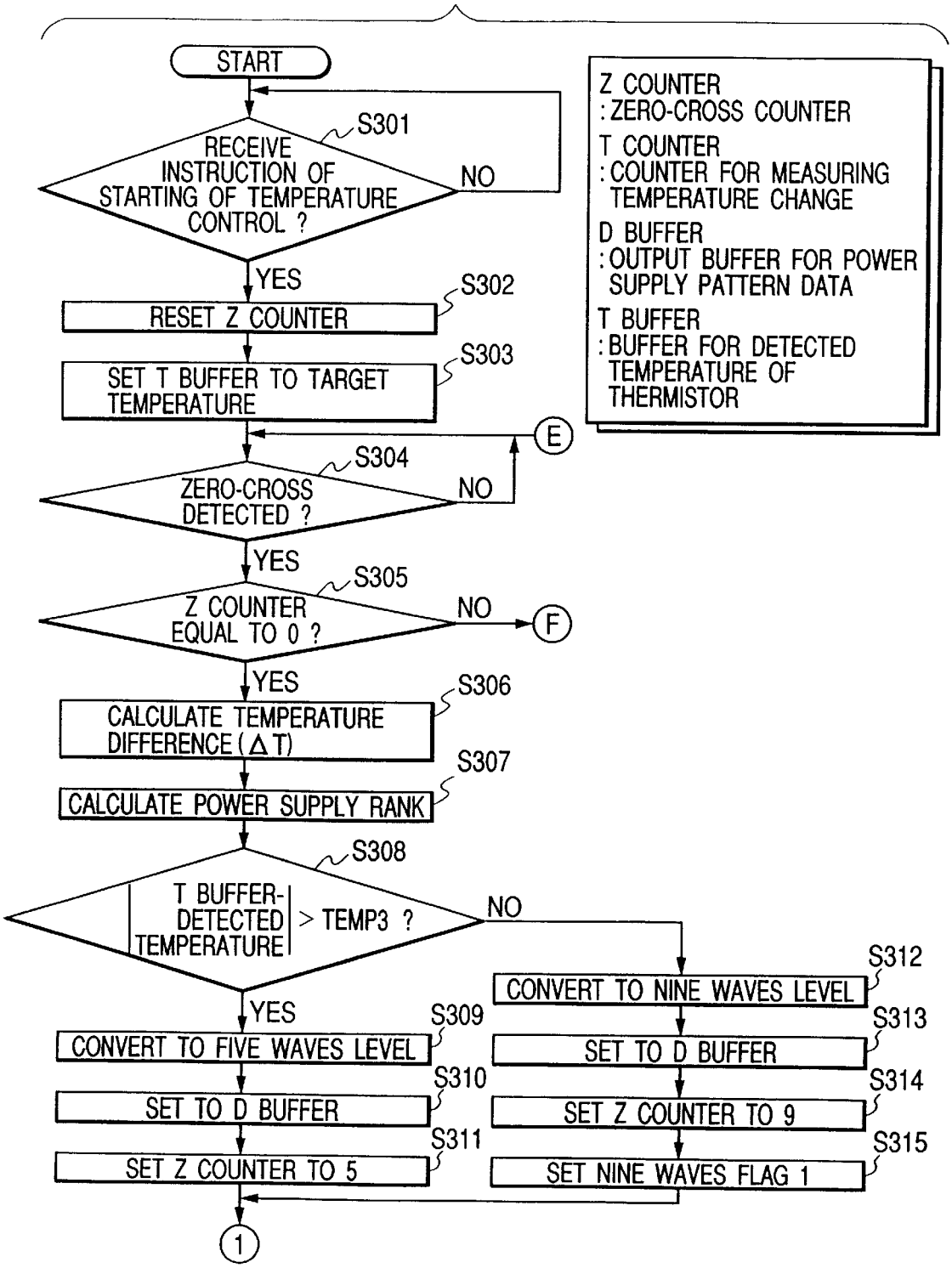
FIG. 8 which is composed of FIGS. 8A and 8B are flowcharts showing a power supply controlling operation according to a third embodiment of the present invention.
Figure 8B:
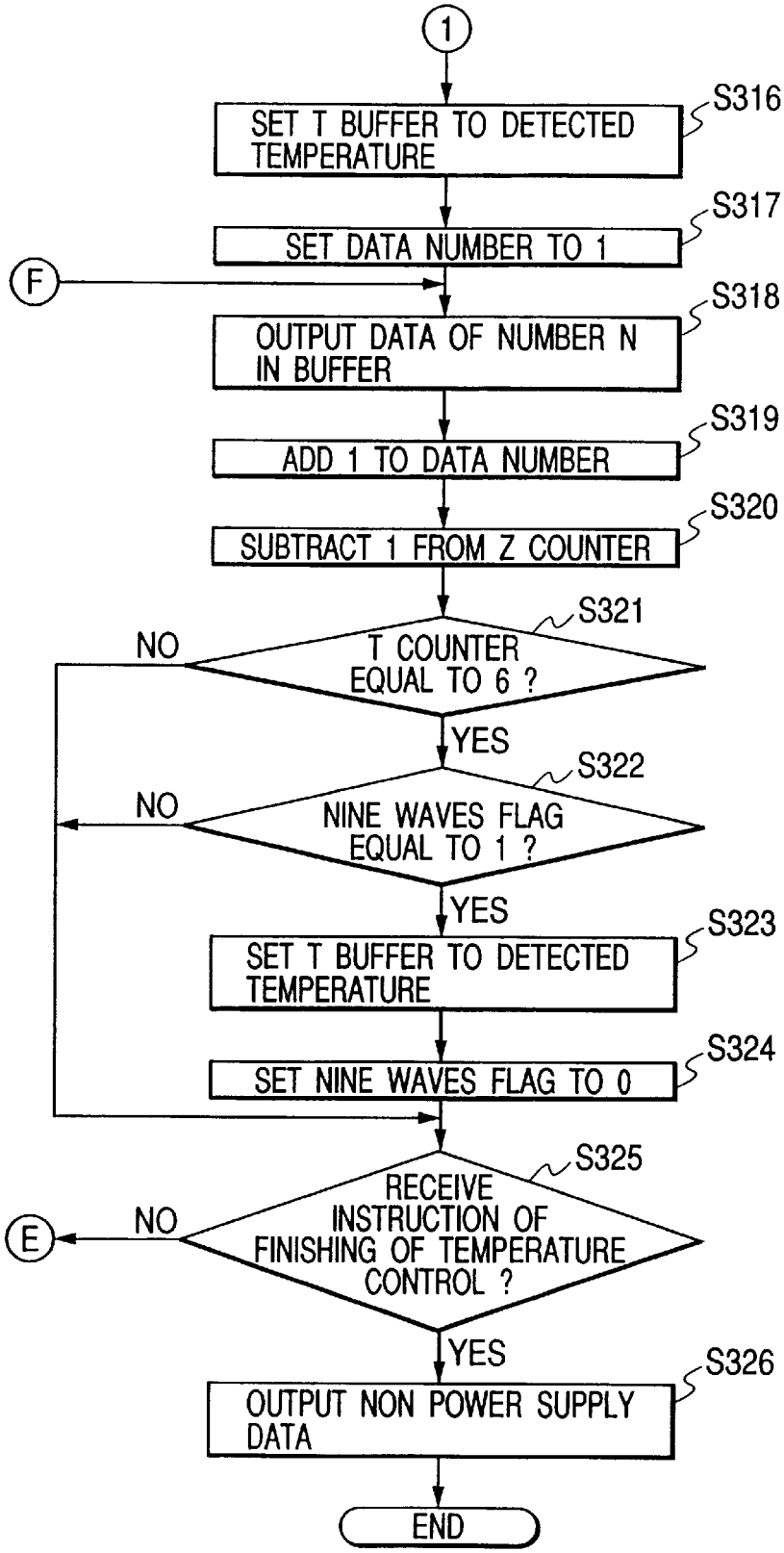

FIGS. 8A and 8B are flowcharts showing a power supply controlling operation of the fixing apparatus according to the third embodiment.

When instruction of starting of temperature control (not shown) is received (step S301), the control portion 3 resets a zero-cross counter (Z counter) to "0" (step S302) and dummy-sets a target temperature to be controlled in a buffer (referred to as "thermistor detection temperature buffer (T buffer)" hereinafter) for temporarily storing the detected temperature of the thermistor (step S303) and waits for the zero-cross signal from the power supply circuit (step S304).

Then, when the control portion 3 receives the zero-cross signal, the control portion 3 discriminates whether the zero-cross counter is "0" or not (step S305). If the zero-cross counter is not "0", the program goes to a step S318 (described later). On the other hand, if the zero-cross counter is "0", the difference $\Delta T$ between the target temperature and the temperature of the heat generating resistor detected by the thermistor 2 is calculated (step S306), and the power supply rank is calculated in accordance with the difference $\Delta T$ on the basis of the correspondence table shown in FIG. 5 (step S307).

Then, the control portion 3 calculates a difference between the present detected temperature of the thermistor 2 and the previous detected temperature stored in the thermistor detection temperature buffer and compares the calculated difference (temperature change amount) with a predetermined temperature Temp3 (step S308). If the difference is greater than the temperature Temp3, the power supply rank previously calculated (in the step S307) is converted into the power supply level in the five waves controlling on the basis of the correspondence table shown in FIG. 5 (step S309), and the power supply pattern data shown in FIG. 4A is stored in an output buffer (D buffer) (step S310), and the zero-cross counter is set to "5" (step S311).

On the other hand, if the temperature change amount is smaller than the temperature Temp3, the control portion 3 converts the power supply rank calculated (in the step S307) into the power supply level in the nine waves controlling on the basis of the correspondence table shown in FIG. 5 (step S312) and stores the power supply pattern data shown in FIG. 4B in the output buffer (step S313) and sets the zero-cross counter to "9" (step S314) and sets a flag (referred to as "nine waves flag" hereinafter) for discriminates whether or not the control is in the nine waves controlling to "1" (step S315).

Then, the control portion 3 stores the present detected temperature of the thermistor 2 in the thermistor detection temperature buffer (step S316) and initializes the data number to "1" (step S317), with the result that the output data of the predetermined period (AC five half waves or AC nine half waves) is set in the output buffer.

After the output data is set in the output buffer or if the zero-cross counter is not "0" (step S305), the control portion 3 outputs the power supply data for each data number ("supplying power" or "not supplying power") in the data buffer to the power supply circuit (step S318).

Thereafter, the control portion 3 adds "1" to the data number (step S319) and subtracts "1" from the zero-cross counter (step S320).

Then, if a temperature change measuring counter is not "6" (step S321) or if the nine waves flag is not "1" (step S322), the program goes to a step S325 (described later). On the other hand, if the temperature change measuring counter is "6" (step S321) and if the nine waves flag is "1" (step S322), the present detected temperature of the thermistor is stored in the thermistor detection temperature buffer (step S323) and the nine waves flag is cleared to "0" (step S324).

The control portion 3 effects the temperature control by repeating the operations from the step S304 to the step S324 until instruction of finishing of temperature control (not shown) is received (step S325). When the control portion 3 receives the instruction of finishing of temperature control, the non-power supply data is outputted to the power supply circuit and the temperature control is finished (steps S325 and S326).

Incidentally, according to the illustrated embodiment, in the five waves controlling, the temperature change amount within the predetermined period (i.e., an interval of five half waves from a first half wave to a fifth half wave (i.e., from data No. 1 to data No. 5)) is used as a parameter for selecting the next predetermined period, and, in the nine waves controlling, the temperature change amount within the predetermined period (i.e., an interval of five half waves from a fifth half wave to a ninth half wave (i.e., from data No. 5 to data No. 9)) is used as a parameter for selecting the next predetermined period.

In this way, since the temperature control is effected by using the five waves controlling if a change amount of the detected temperature of the thermistor 2 upon power supply of immediately before the predetermined number of half waves is great and the temperature control is effected by using the nine waves controlling if such change amount is small, response to the detected temperature of the thermistor in the control portion 3 and fine control of the power supply circuit are compatible, thereby achieving high accurate temperature control.

The present invention is not limited to the above-mentioned embodiments, but various alterations and modifications can be made within the scope of the invention.

What is claimed is:

1. An image heating apparatus comprising:

a heating member for heating an image on a recording material, said heating member generating heat by an alternating current from a commercial power source;

a temperature detecting element for detecting a temperature of said heating member;

control wave number setting means for setting a control wave number of the electric power supplied to said heating member; and electric power supply control means for controlling the electric power supplied to said heating member, said electric power supply control means setting an energizing wave number in the control wave number set by said control wave number setting means in accordance with a detected temperature detected by said temperature detecting element;

wherein said control wave number setting means alternately sets a first control wave number and a second control wave number every time the electric power supplied to said heating member.

2. An image heating apparatus comprising:

a heating member for heating an image on a recording material, said heating member generating heat by an alternating current from a commercial power source;

a temperature detecting element for detecting a temperature of said heating member;

control wave number setting means for setting a control wave number of the electric power supplied to said heating member; and electric power supply control means for controlling an electric power supplied to said heating member, said electric power supply control means setting an energizing wave number in the control wave number set by said control wave number setting means in accordance with a detected temperature detected by said temperature detecting element;

wherein said control wave number setting means sets a first control wave number when the detected temperature is within a predetermined temperature range and sets a second control wave number when the detected temperature is out of the predetermined temperature range.

3. An image heating apparatus according to claim 2, wherein said electric power supply control means controls an electric power supplied to said heating member so that the detected temperature by said temperature detecting element is maintained at a target temperature which is within the predetermined temperature range.

4. An image heating apparatus according to claim 2, wherein the first control wave number is greater than the second control wave number.

5. An image heating apparatus comprising:

a heating member for heating an image on a recording material, said heating member generating heat by an alternating current from a commercial power source;

a temperature detecting element for detecting a temperature of said heating member;

control wave number setting means for setting a control wave number of the electric power supplied to said heating member; and electric power supply control means for controlling an electric power supplied to said heating member, said electric power supply control means setting an energizing wave number in the control wave number set by said control wave number setting means in accordance with a detected temperature detected by said temperature detecting element;

wherein said control wave number setting means sets the control wave number in accordance with a temperature changing rate of said heating member.

6. An image heating apparatus according to any of claims 1, 2 and 5, further comprising a film moving while being in contact with said heating member, and a back-up member cooperating with said heating member for interposing said film therebetween to form a nip for pinching and conveying a recording material.

* * * * *

UNITED STATES PATENT AND TRADEMARK OFFICE

CERTIFICATE OF CORRECTION

PATENT NO. : 6,177,657 B1
DATED : January 23, 2001
INVENTOR(S) : Shinichi Takata It is certified that error appears in the above-identified patent and that said Letters Patent is hereby corrected as shown below:

Column 6,
Line 29, "Temp" should read -- Temp 1 --.

Column 8,
Line 3, "discriminates" should read -- discriminating --.

Column 9,
Line 10, "power" should read -- power is --.

Signed and Sealed this

Thirtieth Day of October, 2001

*Attest:*

Nicholas P. Godici

*Attesting Officer*

NICHOLAS P. GODICI
*Acting Director of the United States Patent and Trademark Office*